US005520497A

United States Patent [19]

Hertelendi et al.

[11] Patent Number: 5,520,497

[45] Date of Patent: May 28, 1996

[54] RAIL LOADING TRAIN FOR TRANSPORTING AS WELL AS LOADING AND UNLOADING LONG RAILS

[75] Inventors: Josef Hertelendi, Freilassing; Bruno Ströbl, Unterhaching, both of Germany

[73] Assignee: Georg Robel G.m.b.H. & Co., München, Germany

[21] Appl. No.: 228,742

[22] Filed: Apr. 18, 1994

[30] Foreign Application Priority Data

Apr. 21, 1993 [DE] Germany ..... 43 12 964.1

[51] Int. Cl.[6] ..... B65G 13/00

[52] U.S. Cl. ..... 414/529; 193/37; 104/2; 105/355

[58] Field of Search ..... 414/23, 529, 530, 414/531, 532, 533, 534, 535, 536, 340, 341, 343, 345, 349, 339, 351, 352, 353, 431; 280/414.1, 414.2, 414.3; 104/2; 296/151, 182, 183; 410/33, 53, 44, 95, 46, 77, 92; 105/238.1, 355, 356, 392, 404; 193/37

[56] References Cited

U.S. PATENT DOCUMENTS 4,050,561 9/1977 Seitz ..... 193/37 X 4,636,130 1/1987 Lenertz et al. ..... 105/355 X

FOREIGN PATENT DOCUMENTS 748179 12/1966 Canada ..... 104/2
1208326 1/1966 Germany .
2734748 8/1980 Germany .
1266771 10/1986 U.S.S.R. ..... 414/23
1459958 2/1989 U.S.S.R. ..... 105/355

*Primary Examiner*—Frank E. Werner
*Attorney, Agent, or Firm*—Henry M. Feiereisen

[57] ABSTRACT

A rail loading train for transporting as well as loading and unloading long rails includes a loading car with a frame which is supported on undercarriages for movement in an operating direction. Mounted on the frame of each loading car are a plurality of spaced rail supports for carrying the long rails. Each rail support includes a shaft which is swingably mounted at one end to a column and is shiftable between an idle position in which the shaft extends longitudinally in direction of the track and a receiving position in which the shaft extends across the frame. The shaft is provided with a number of neighboring pairs of flange rollers, with each flange roller having at least one end provided with a flange.

18 Claims, 1 Drawing Sheet

RAIL LOADING TRAIN FOR TRANSPORTING AS WELL AS LOADING AND UNLOADING LONG RAILS

BACKGROUND OF THE INVENTION

The present invention refers to a rail loading train for transporting as well as loading and unloading long rails, and in paticular to a rail loading train of the type having a loading car supported on undercarriages for movement in an operating direction and provided with rail supports which are fitted with rollers for carrying the long rails, and optionally may have vertical spacers extending between the rollers.

German Patent Nos. DE 12 08 326 B and DE 27 34 748 B disclose a rail loading train of this type, with the train comprised of a plurality of cars coupled to each other. The rail supports for carrying the long rails being transported are mounted to the machine frame of the cars and spaced from each other longitudinally in direction of the track. The rail supports are provided with rollers which are sequentially arranged in a direction transversely to the machine frame and respectively carry a rail. The rollers are separated from each other by elongated spacers for distancing neighboring rails extending transversely to the machine frame. A drawback of such rail supports is the occurrence of a friction between the rail base and the adjacent spacer, which has to be overcome and requires significant pulling forces during loading and unloading of the rails.

SUMMARY OF THE INVENTION

It is thus an object of the present invention to provide an improved rail loading train for transporting as well as loading and unloading long rails obviating the afore-stated drawbacks.

It is another object of the present invention to provide an improved rail loading train by which frictional forces during loading and unloading of long rails being transported are considerably reduced.

These objects and others which will become apparent hereinafter are attained in accordance with the present invention by providing each roller in form of a flange roller with at least one terminal flange.

Through the provision of such flange rollers for supporting long rails, frictional forces are essentially eliminated in a simple manner in the area of the rail base. In particular in connection with very long rails at a length of e.g. 300 m, the significant reduction of frictional forces proves advantageous because rails of such length and weight can still be hauled by bulldozers used primarily for such purposes, without exceeding the admissible axle load and thus without requiring a reinforcement of the bulldozer. In addition, existing rail loading trains can easily be retrofitted in a manner according to the present invention.

Suitably, a long rail is supported by a pair of neighboring flange rollers which are spaced from each other transversely to the machine frame, with the flange of each flange roller being arranged at the end opposite to the facing ends of the neighboring flange rollers. The rollers are suitably fitted on a shaft which is supported by a plurality of bearings positioned between neighboring flange rollers. In this manner, the shaft is securely supported and a maximum number of pairs of flange rollers can be fitted on the shaft transversely to the machine frame.

According to another feature of the present invention, a spacer extends above two adjoining flange rollers, with their flanges arranged back-to-back, and with the width of the spacer substantially corresponding to the width of the pair of adjoining flange roller arranged below the spacer. Thus, a long rail can be precisely centered for transport before being placed on the pair of rollers so that the rail base is laid without any problems between both flanges of a pair of flange rollers.

Preferably the difference between the diameter of the flange roller and the diameter of the pertaining flange corresponds to the height of a rail base, i.e. about 10 to 15 mm so that a secure transverse guidance of the long rail is ensured also during travel through a curved track.

BRIEF DESCRIPTION OF THE DRAWING

The above and other objects, features and advantages of the present invention will now be described in more-detail with reference to the accompanying drawing in which.

DESCRIPTION OF PREFERRED EMBODIMENTS

Figure 1:
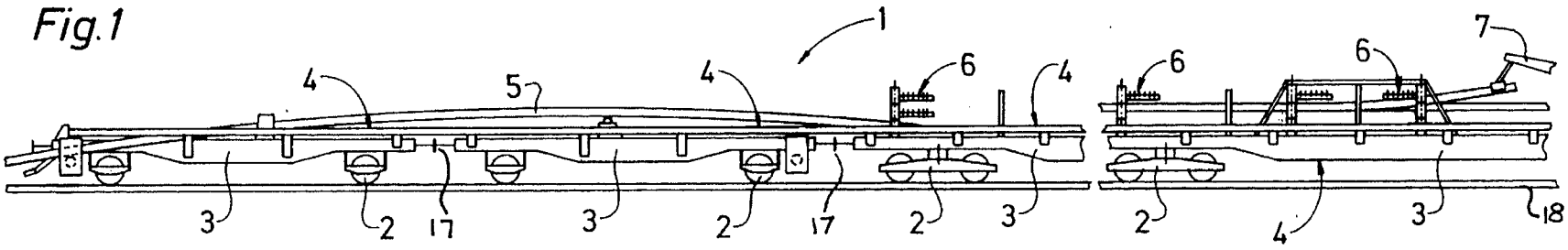
FIG. 1 is a fragmentary side elevational view of one embodiment of a rail loading train according to the present invention for transport of long rails.

Throughout all the Figures, the same or corresponding elements are always indicated by the same reference numerals.

Referring now to the drawing, and in particular to FIG. 1, there is shown a fragmentary side elevational view of one embodiment of a rail loading train according to the present invention, generally designated by reference numeral 1. The rail loading train 1 is comprised of a plurality of sequentially arranged loading cars 4 which are suitably linked to each other by couplings, schematically indicated at 17. Each loading car 4 has an elongated car frame 3 which is supported on undercarriages 2 for movement along track 18 in an operating direction. In the nonlimiting example of FIG. 1, the rail loading train 1 is used for hauling long rails 5, e.g. continuous welded rails (CWR), which are carried by a plurality of rail supports, generally designated by reference numeral 6. The rail supports 6 are mounted to the car frame 3 at a suitable distance to each other, and each rail support 6 is movable between an idle position in which the rail support 6 extends longitudinally in direction of the track 18 and car 4 and a receiving position in which the rail support 6 extends transversely across the car 4 for supporting a rail 5. For illustrative purposes, FIG. 1 shows some rail supports 6 in the idle position and some rail supports 6 in the receiving position. Persons skilled in the art will understand that the shift of the rail supports 6 between the idle position and the receiving position can be carried out manually or automatically in various ways. However, for sake of simplicity, necessary elements have been omitted from the drawings.

Mounted on one of the cars 4 is a boom 7 which is part of a gantry crane secured on the car frame 3 for traveling longitudinally in direction of the car 4 and for transmittal of pulling or thrust forces.

Figure 2:
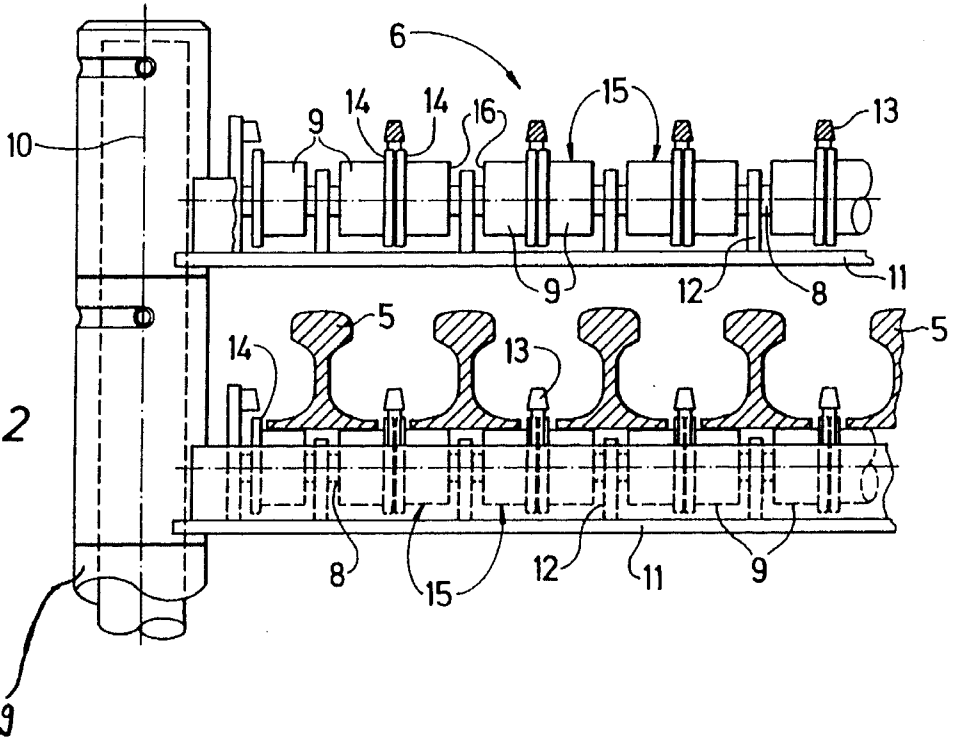
FIG. 2 is an enlarged view of a rail support provided on the rail loading train.

As shown in FIG. 2, each rail support 6 includes a vertical column or post 19 which is secured on the car frame 3. Mounted to the post 19 are one ends of horizontal and superimposed shafts 8 which swing about a vertical axis 10 so as to be movable between the idle position and the receiving position. Each shaft 8 carries a plurality of flange rollers 9 which are arranged sequentially next to each other in pairs. Preferably, each shaft 8 of the rail support 6 carries a total of twenty flange rollers 9 for support of ten long rails 5.

Extending in parallel relationship to the shaft 8 is a base carrier 11 which is provided with a plurality of spaced upright bearings 12 for bracing the shaft 8. The base carrier 11 is of essentially U-shaped configuration and supports a plurality of elongated spacers 13 which are respectively arranged at a central location between each pair of successive bearings 12 and extend longitudinally in direction of the track 18 when shifting the rail supports 6 to its receiving position. As best seen in FIG. 2, the sides of the base carrier 11 are sufficiently low height to avoid interference with the rails 5. Each flange roller 9 includes in the area of the spacer 13 a flange or projecting rim 14. Two flange rollers 9 form a roller pair 15 between two successive spacers 13 for commonly supporting a long rail 5, with the flanges 14 being respectively provided at the end opposite to the facing neighboring ends of the roller pair 15.

Figure 3:
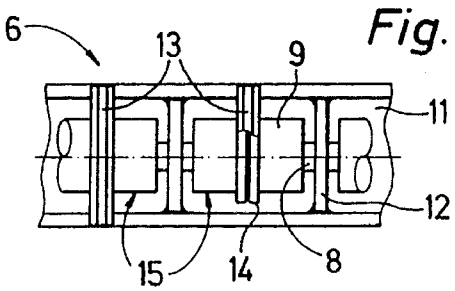
FIG. 3 is a fragmentary plan view of the rail support.

As best seen in FIG. 3, each spacer 13 has a width which substantially corresponds to the width of two flanges 14 situated below the spacer 13. The difference between the diameter of the cylindrical section of the flange roller 9 supporting the long rail and the diameter of the flange 14 is preferably in the range of about 10 to about 15 mm.

Figure 4:
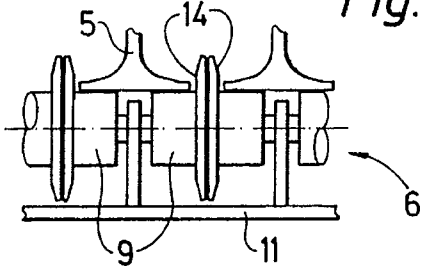
FIG. 4 is a fragmentary view, similar to FIG. 2, of a variation of a rail support according to the present invention.

Turning now to FIG. 4, there is shown a variation of a rail support 6 according to the present invention, with the difference to the rail support 6 of FIG. 2 residing in the design of the spacer. In the embodiment of the rail support 6 of FIG. 4, the provision of a separate spacer is omitted by providing the flange roller 9 with a significantly enlarged flange 14 which thus fulfills a dual function, i.e. a centering and a lateral guidance of the long rail 5.

While the invention has been illustrated and described as embodied in a rail loading train for transporting as well as loading and unloading long rails, it is not intended to be limited to the details shown since various modifications and structural changes may be made without departing in any way from the spirit of the present invention.

What is claimed as new and desired to be protected by Letters Patent is set forth in the appended claims:

1. A rail loading train for transporting long rails; comprising:

a loading car having a frame defined by a longitudinal axis and supported on undercarriages for movement in an operating direction;

support means mounted on said frame and including rollers for supporting long rails, each said roller being provided in form of a flange roller having at least one end provided with a flange, said flange rollers being grouped in neighboring pairs of spaced flange rollers, with each pair of flange rollers supporting a long rail between their flanges, and with adjoining flanges of neighboring pairs of flange rollers being arranged in back-to-back formation wherein said support means includes at least one shaft for supporting pairs of neighboring flange rollers; and bearing means positioned between said flange rollers of each pair of flange rollers for bracing said shaft.

2. The rail loading train of claim 1 wherein said support means includes a spacer located above said flanges of said flange rollers.

3. The rail loading train of claim 2 wherein said spacer has a width and said flange of said flange rollers has a width, the width of said spacer substantially corresponding to the width of two adjoining flanges arranged below said spacer.

4. The rail loading train of claim 1 wherein said flange roller has a diameter and said flange of said flange rollers has a diameter, the diameter of said flange roller being smaller than the diameter of said flange by a height of a rail base which is about 10 to 15 mm.

5. The rail loading train of claim 1 wherein said shaft carries twenty successively arranged flange rollers for supporting ten long rails.

6. The rail loading train of claim 1 wherein said flange of each flange roller is extended to define a spacer.

7. A support device for use on a loading car of a rail loading train for hauling rails, in particular long rails, comprising:

a vertical support column secured to a frame of the loading car;

a shaft having one end swingably mounted to said column so as to be movable between an idle position in which said shaft extends longitudinally in direction of the loading car and a receiving position in which said shaft extends across the loading car;

a plurality of rollers fitted on said shaft for receiving the rails, each said roller having at least one end provided with a flange, wherein said rollers are grouped in neighboring pairs of spaced rollers, with each pair of rollers supporting a rail between their flanges, and with adjoining flanges of neighboring pairs of rollers being arranged in back-to-back formation; and bearing means positioned between said rollers of each pair of rollers for bracing said shaft.

8. The rail loading train of claim 7, and further comprising a spacer located above said flanges of said rollers for centering the rails.

9. The support device of claim 8 wherein said spacer has a width and said of said flange rollers has a width, the width of said spacer substantially corresponding to the width of two adjoining flanges arranged below said spacer.

10. The support device of claim 7 wherein said roller has a diameter and said flange of said rollers has a diameter, the diameter of said flange roller being smaller than the diameter of said flange by the height of a rail base which is about 10 to 15 mm.

11. The support device of claim 7 wherein said shaft carries twenty successively arranged rollers for supporting ten rails.

12. The support device of claim 7 wherein said flange of each roller is extended to define a spacer.

13. A rail loading train for long rails; comprising:

a loading car having a frame defined by a longitudinal axis and supported on undercarriages for movement in an operating direction;

support means mounted on said frame and including rollers for supporting long rails, each said roller being provided in form of a flange roller having at least one end provided with a flange, said flange rollers being grouped in neighboring pairs of spaced flange rollers, with each pair of flange rollers supporting a long rail between their flanges, and with adjoining flanges of neighboring pairs of flange rollers being arranged in back-to-back formation; and bearing means positioned between flange rollers of each pair of neighboring flange rollers for bracing said support means.

14. The rail loading train of claim 13 wherein said support means includes at least one shaft for supporting pairs of neighboring flange rollers, said bearing means being positioned between said flange rollers of each pair of flange rollers for bracing said shaft.

15. The rail loading train of claim 14 wherein said shaft carries twenty successively arranged flange rollers for supporting ten long rails.

16. The rail loading train of claim 13 wherein said support means includes a spacer located above said flanges of said flange rollers.

17. The rail loading train of claim 16 wherein said spacer has a width and said flange of said flange rollers has a width, the width of said spacer substantially corresponding to the width of two adjoining flanges arranged below said spacer.

18. The rail loading train of claim 13 wherein said flange roller has a diameter and said flange of said flange roller has a diameter, the diameter of said flange roller being smaller than the diameter of said flange by a height of a rail base which is about 10 to 15 mm.

* * * * *